US005156497A

United States Patent [19]

Gaskins

[11] Patent Number: 5,156,497

[45] Date of Patent: Oct. 20, 1992

[54] TEMPORARY ROOF SUPPORT FOR MINES

[75] Inventor: Paul M. Gaskins, Bristol, Tenn.

[73] Assignee: Simmons-Rand Company, Bristol, Va.

[21] Appl. No.: 796,986

[22] Filed: Nov. 25, 1991

[51] Int. Cl.[5] ..... E21D 19/00; E21D 20/00

[52] U.S. Cl. ..... 405/291; 405/303

[58] Field of Search ..... 405/259.1, 290, 291, 405/293, 295, 296, 303; 248/354.1, 357; 299/31, 33

[56] References Cited

U.S. PATENT DOCUMENTS 3,959,976 6/1976 Blumenthal .
3,961,487 6/1976 Blumenthal .
3,971,225 7/1976 Wertelewski et al. .
4,236,850 12/1980 Koppers et al. .
4,252,475 2/1981 Cobb et al. ..... 405/291
4,266,891 5/1981 Plevak et al. .
4,269,547 5/1981 Harding ..... 405/303
4,284,368 8/1981 Albright ..... 405/291
4,297,057 10/1981 O'Neil ..... 405/303
4,460,294 7/1984 Cobb et al. .
4,595,316 6/1986 Tinnel ..... 405/291
4,662,796 5/1987 Fanget ..... 405/296
4,797,023 1/1989 Park .

*Primary Examiner*—David H. Corbin
*Attorney, Agent, or Firm*—John J. Selko

[57] ABSTRACT

A temporary support for a mine roof is mounted on a mobile roof bolter, and includes a main support frame pivotably connected to the bolter, a main support beam and a ground contacting beam, both extending along the same axis in front of the main support frame, and connected to each other and to the main support frame by a scissors pivot joint and a leveling pivot joint, respectively. When the scissors pivot joint opens and closes, the main support beam and ground contact beam raise and lower with respect to each other and with respect to the ground. A cross beam is mounted on the main support beam and transverse to the axis thereof, and raises and lowers in the same plane with respect to the mine face, to contact and support the mine roof.

8 Claims, 5 Drawing Sheets

TEMPORARY ROOF SUPPORT FOR MINES

BACKGROUND OF THE INVENTION

This invention relates generally to a device for temporarily supporting a mine roof, and more particularly to a temporary roof support device that is mounted on a mobile roof bolter. Temporary roof supports must be capable of being elevated to support a mine roof, and collapsed to a narrow height for easy transport in a mine. Prior art devices require bulky equipment mounted on the front of the roof bolter, in order to provide sufficient support strength, resulting in a mobile unit that is front-heavy, and one that lacks a desirable collapsibility and transportability. The foregoing illustrates limitations known to exist in prior art temporary roof support devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a roof support device mounted in front of a mobile roof bolter, the device including a main support frame pivotably connected to the main frame of the roof bolter; a main support beam extending in front of the support frame, having a front end terminating adjacent a mine face and a back end terminating above the support frame; a cross beam pivotably attached to the main support beam and transverse thereto; a ground contact beam extending in front of the support frame and below the main support beam, having a back end pivotably connected to the support frame; scissors pivot means extending between the main support beam and the ground contact beam; cylinder means for opening and closing the scissor means; and leveling pivot means connecting the back end of the primary support beam to the support frame, for permitting the support beam to raise and lower in a vertical plane in relation to the support frame, when the scissors means opens and closes, whereby the cross beam is raised and lowered vertically in the same plane adjacent a mine face.

The foregoing and other aspects will become apparent from the following detailed description of th invention when considered in conjunction with the accompanying drawing figures.

BRIEF DESCRIPTION OF THE DRAWING FIGURES

DETAILED DESCRIPTION

Figure 1:
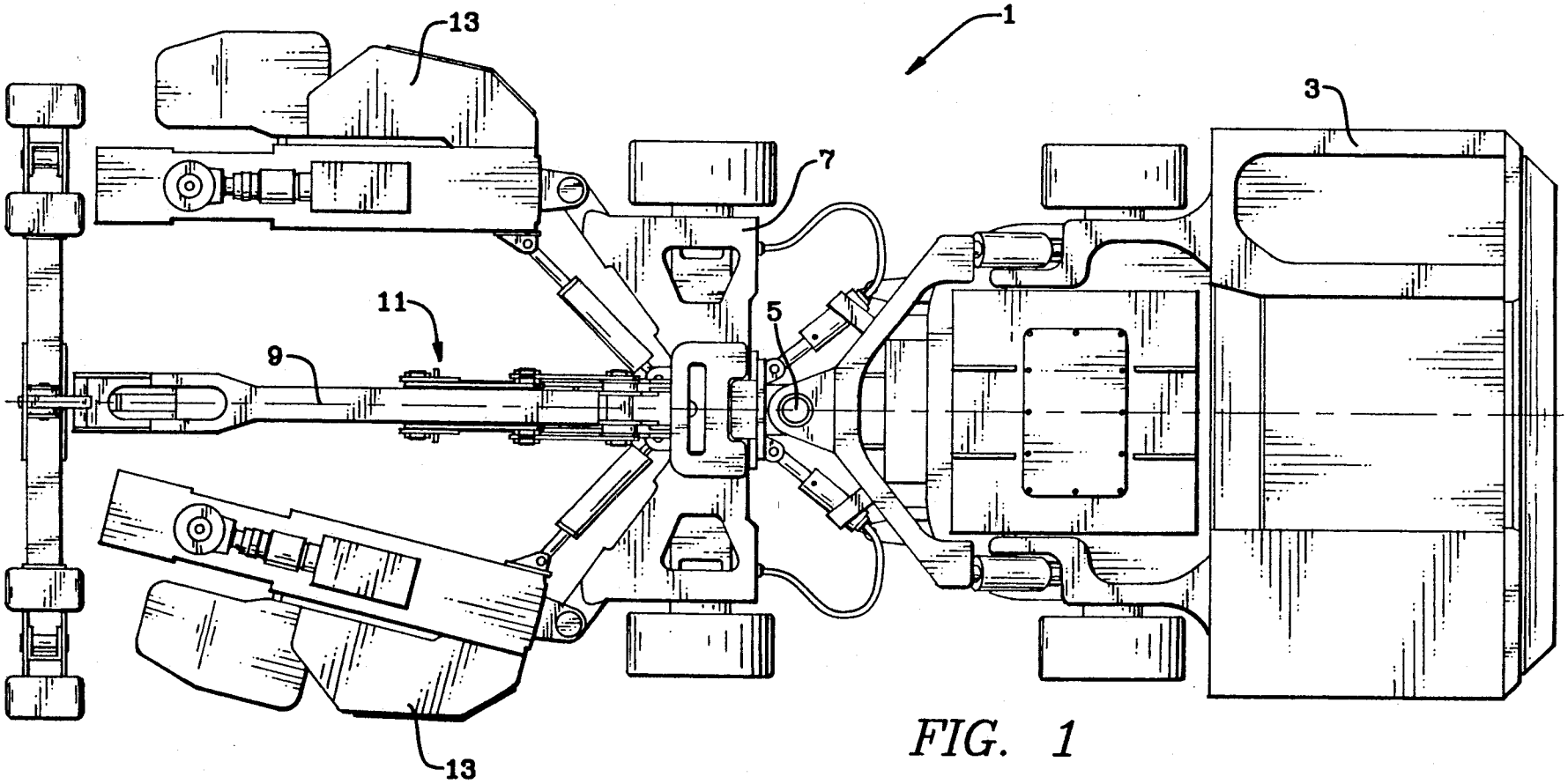
FIG. 1 is schematic plan view of an automated roof bolter, with parts not shown.

Referring now to FIG. 1 there is shown a wheeled, mobile roof bolter 1 having a rear frame portion 3, a center frame portion 5 in front of rear frame portion 3, and a front frame portion 7 in front of the center frame portion 5, pivotably connected thereto. A longitudinal axis 9 extends along the length of the roof bolter 1, and frame portions 3,5 and 7 are aligned on axis 9, as is conventional. Mounted on the roof bolter 1 are well known operational devices such as batteries, motors, fans and control equipment. Such devices do not form part of this invention, and are not shown. Positioned in front of front frame portion 7 and extending along axis 9 is an automated temporary roof support 11, hereinafter referred to as "ATRS," the invention herein. Pivotably connected to front frame portion 7, on both sides of the ATRS and axis 9 is a drill boom 13, of conventional design.

Figure 2:
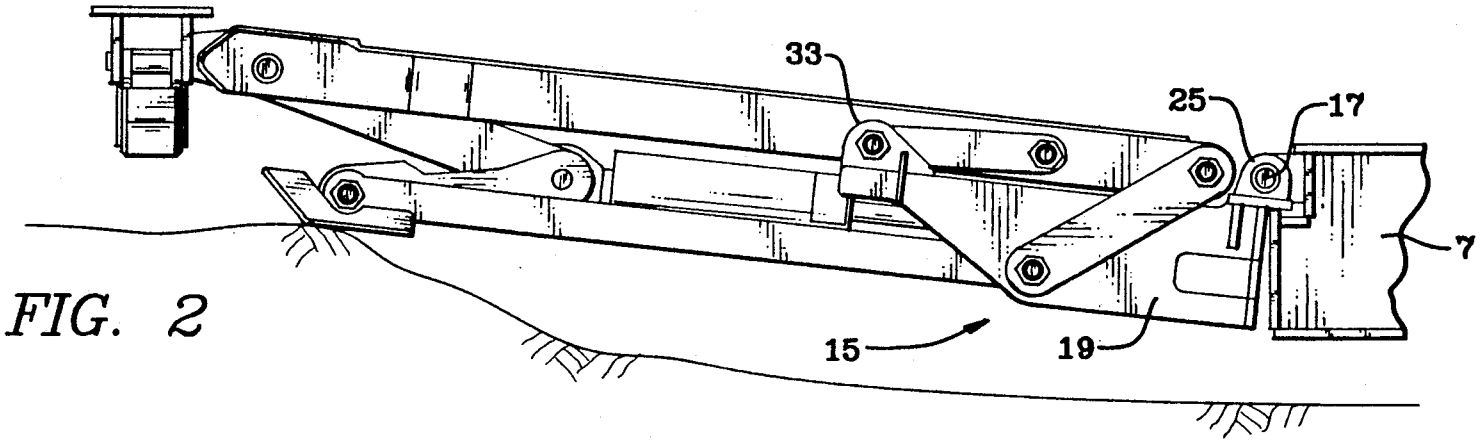
FIG. 2 is a side elevational view of the invention, with parts not shown, in the fully collapsed position, and pivoted upward over uneven terrain.
Figure 4:
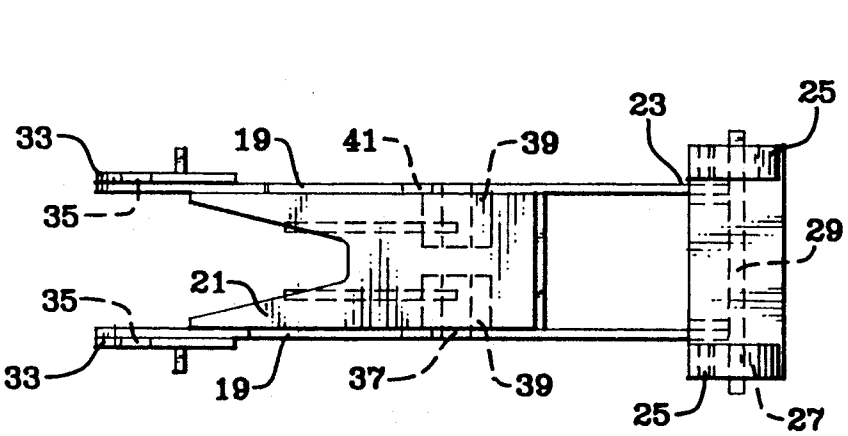
FIG. 4 is a top plan view of the main support frame of the invention.
Figure 3:
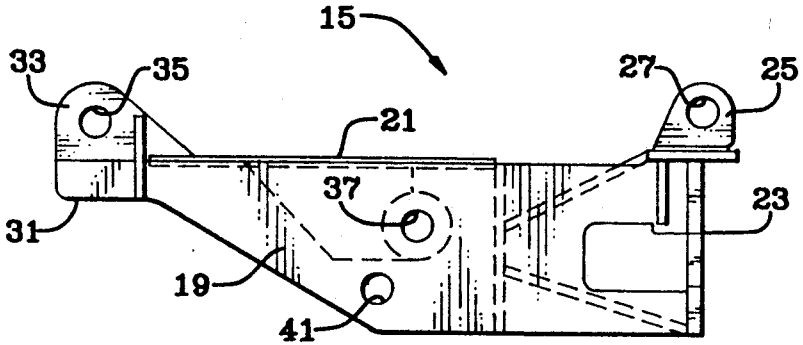
FIG. 3 is a side elevational view of the main support frame of the invention.

As shown in FIGS. 2,3 and 4, the ATRS includes a main support frame 15 pivotably connected to front frame 7 at pivot axis 17. Main support frame 15 comprises a pair of spaced-apart, upstanding sidewalls 19 connected by a top plate 21. Other structural members can be added for strength, as is well known. Back end 23 of each sidewall 19 terminates in a upstanding lug 25 having a bore 27 therethrough. Lugs 25 are parallel to each other, and are journaled around horizontally extending pivot pin 29 on the front of front frame 7, so that main support frame 15 can be pivoted up and down, about pivot axis 17, in a vertical direction in relation to the ground.

Front end 31 of each sidewall 19 terminates in an upstanding lug 33 having a bore 35 therethrough, for receiving a pivot pin, as described hereinafter.

Extending through each sidewall 19, about mid-way along the length thereof, is a first sidewall bore 37. Each bore 37 is reinforced by cylindrical boss 39, extending between sidewalls 19, for receiving a pivot pin, as described hereinafter. Extending through each sidewall 19 between first sidewall bore 37 and front end 31 of main support frame 15, at an elevation slightly lower than first sidewall bore 37 is a second sidewall bore 41, for receiving a pivot pin, as described hereinafter.

Figure 5:
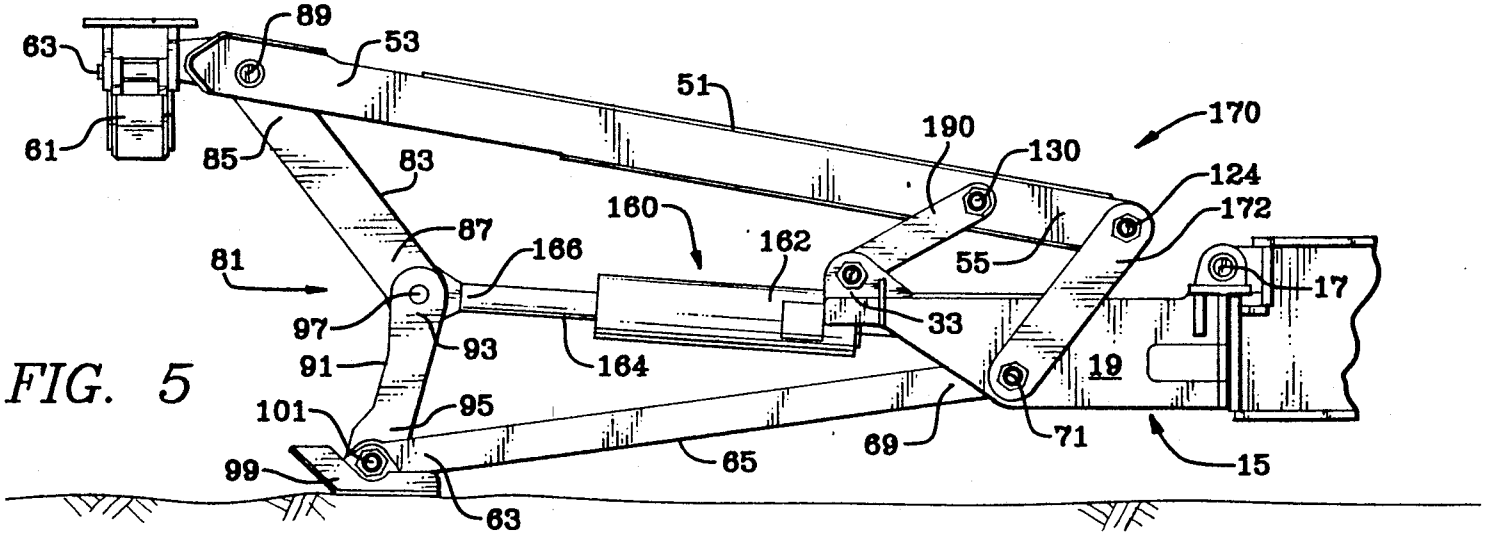
FIG. 5 is a side elevational schematic view of the invention, with parts not shown.

Now referring to FIG. 5, the ATRS 11 is shown to further comprise a main support beam 51 in front of main support frame 15, and extending along axis 9. Main support beam 51 has a front end 53 that terminates adjacent a mine face (not shown), and a back end 55 that terminates above main support frame 15. Main support beam 51 is adapted for raising and lowering above main support frame 15 in a vertical plane that extends along axis 9, as hereinafter described.

A cross beam 61 extends in a plane transverse to axis 9, and is pivotably attached to main support beam 51 at a cross beam pivot joint 63, as hereinafter described. Cross beam 61 is adapted to be raised into contact with, and temporarily support a mine roof.

A ground-contact beam 65 extends in front of main support frame 15, along axis 9. Ground-contact beam 65 is positioned below main support beam 51, and has a front end 67 terminating below the front end 53 of main support beam 51, and a back end 69 that is pivotably connected to main support frame 15 at sidewall pivot joint 71. Back end 69 is journaled around pivot pin (not shown) extending between sidewalls 19, through second sidewall bore 41. Ground-contact beam 65 is adapted for raising and lowering its front end 67 below main support frame 15, in the same vertical plane in which main support beam 51 raises and lowers, that is, the plane along the horizontal axis 9.

Extending between front end.. 53 of main support beam 51 and front end 67 of ground-contact beam 65 is scissors pivot means, shown generally as 81. Scissors pivot means 81 includes primary strut 83 having a top end 85 and a bottom end 87. Top end 85 is pivotably connected to front end 53 of main support beam 51 at a top strut pivot joint 89, said top strut pivot joint 89 being adjacent to cross beam pivot joint 63, as described hereinafter. Scissors pivot means 81 also includes a secondary strut 91 having a top end 93 and a bottom end 95. Top end 93 is pivotably connected to a scissors pivot joint 97, along with bottom end 87 of primary strut 83.

Bottom end 95 has pivotably connected thereto a foot weldment, shown generally as 99. Foot weldment 99 is of conventional design, and is pivotably connected to a foot weldment pivot joint 101, by means of a clevis and pin combination (not shown) at pivot joint 101, along with front end 67 of ground-contact beam 65. Foot weldment 99 is adapted to contact the ground and support the ATRS, when the ground-contact beam 65 is lowered.

Figure 6:
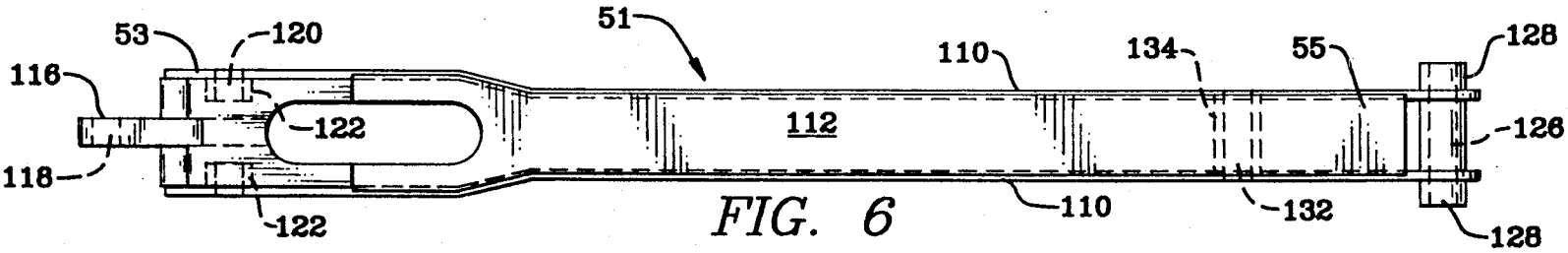
FIG. 6 is a top plan view of the main support beam of the invention, with parts not shown.
Figure 7:
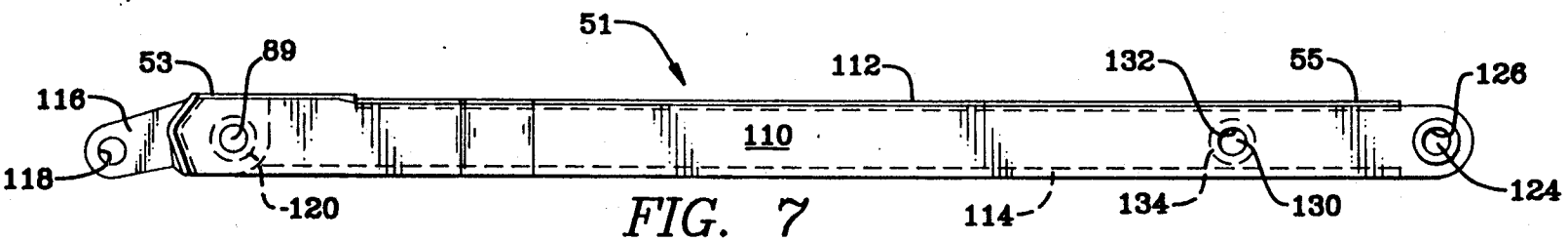
FIG. 7 is a side elevational view of the main support beam of the invention, with parts not shown.

As shown in FIGS. 6 and 7, main support beam 51 comprises mainly a hollow, elongated box-like member having a pair of upstanding, spaced-apart, parallel sidewalls 110, with a top plate 112 and a bottom plate 114 connected therebetween. Front end 53 of support beam 51 terminates in a forward extending lug 116 having a bore 118 therethrough. Bore 118 is pivotably connected to cross beam 61, at cross beam pivot joint 63, as described hereinafter. Adjacent to cross beam pivot joint 63, and spaced between sidewalls 110, is top strut pivot joint 89, about which top end 85 of primary strut 83 is pivotably connected, as described hereinabove. Top strut pivot joint 89 includes bore 120 and reinforcing cylindrical bosses 122 extending between sidewalls 110. Top end 85 of primary strut 8 is journaled around pivot pin (not shown), between sideplates 110.

Back end 55 of support beam 51 terminates in a support beam back pivot joint 124 transverse to axis 9, with a bore 126 therethrough. Bore 126 has cylindrical reinforcing bosses 128 extending outwardly from sidewalls 110. Support beam 51 includes an intermediate pivot joint 130 adjacent to back pivot joint 124, and transverse to axis 9, with a bore 132 therethrough. Intermediate pivot joint 130 includes cylindrical bosses 134 extending between sidewalls 110.

Figure 8:
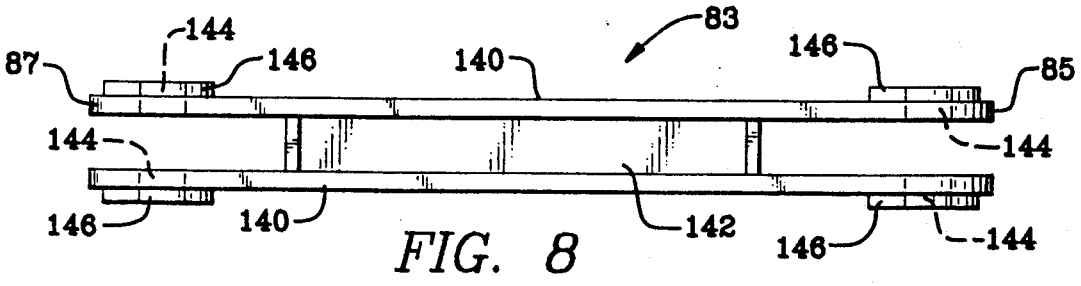
FIG. 8 is a plan view of the primary strut of the invention.

As shown in FIG. 8, primary strut 83 is a pair of spaced-apart sidewalls 140 connected by a central web 142 therebetween. Each sidewall 140 has a bore 144 at top and bottom end 85 and 87, respectively, reinforced by a cylindrical boss 146. Top end 85 of strut 83 is journaled around a pivot pin (not shown) in top strut pivot joint 89 (FIG. 5). Bottom end 87 of strut 85 is journaled around a pivot pin (not shown) in scissors pivot joint 97 (FIG. 5).

Figure 9:
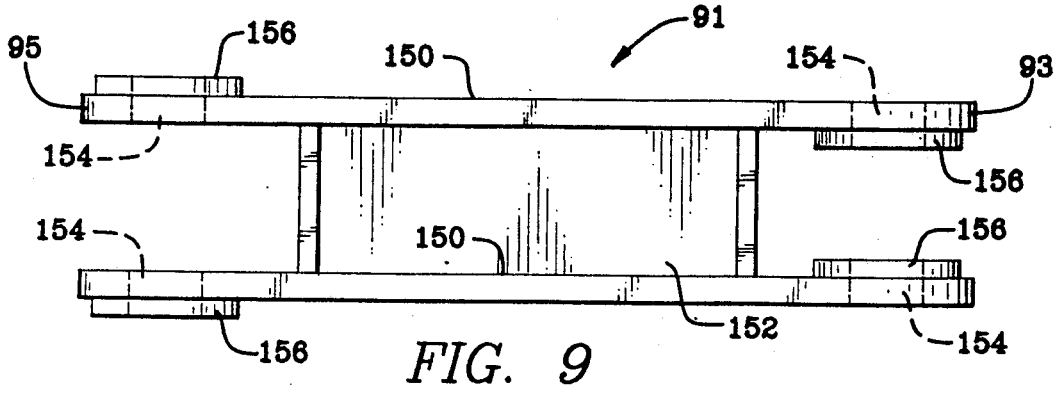
FIG. 9 is a plan view of the secondary strut of the invention.

As shown in FIG. 9 secondary strut 91 is a pair of spaced-apart sidewalls 150 connected by a central web 152 therebetween. Each sidewall 150 has a bore 154 at top and bottom end 93 and 95, respectively, reinforced by a cylindrical boss 156. Top end 93 of strut 91 is journaled around a pin (not shown) in scissors pivot joint 89, along with bottom end 87 of primary strut 83 (FIG. 5). Bottom end 95 of secondary strut 91 is journaled around a pivot pin (not shown) in foot weldment pivot joint 101 (FIG. 5).

Figure 10:
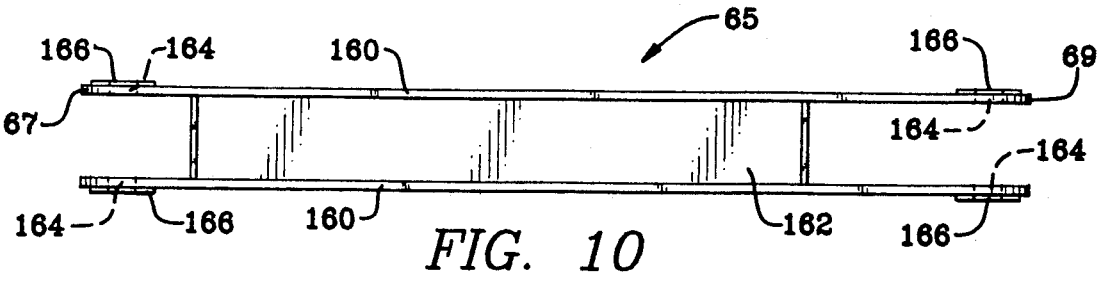
FIG. 10 is plan view of the ground-contact beam of the invention.

As shown in FIG. 10, ground-contact beam 65 is a pair of spaced-apart sidewalls 160 connected by a central web 162 therebetween. Each sidewall 160 has a bore 164 at front end and back end 67 and 69, respectively, reinforced by a cylindrical boss 166. Back end 69 of ground-contact beam 65 is journaled around a pivot pin (not shown) in sidewall pivot joint 71 in front frame 15 (FIG. 5). Front end 67 is journaled around a pivot pin (not shown) in foot weldment pivot joint 101.

Referring to FIG. 5, primary support cylinder means, shown generally as 160, includes a hydraulically operated cylinder 162, with and extendable shaft 164 therein, as is well known. Primary cylinder means 160 is positioned along axis 9, with front end 166 of shaft 164 pivotably connected to scissors pivot joint 97, along with bottom end 87 of primary strut 83 and top end 93 of secondary strut 91. Back end of cylinder 162 is journaled around a pivot pin (not shown) extending between sidewalls 19 of main support frame 15, at sidewall pivot joint 71.

Primary cylinder means 160 is a driven by conventional hydraulic circuitry connected to the hydraulic system of the roof bolter. Thus, it should be understood that, as primary cylinder means 160 extends and retracts shaft 164, it opens and closes scissors pivot means 81, thereby raising and lowering main support beam 51 and ground-contact beam 65, in relation to each other and in relation to the ground.

Referring again to FIG. 5, leveling pivot means, referred to generally as 170, is shown pivotably connected to both back end 55 of main support beam 51 main support frame 15. Leveling pivot means 170 permits back end 55 of support beam 51 to raise and lower in the vertical plane extending along the longitudinal axis 9, in relation to main support frame 15, when scissors pivot means 81 opens and closes, whereby cross beam 61 raises and lowers vertically in a plane that is transverse to axis 9, and in substantially the same position relative to the mine face, when the ATRS is raised and lowered.

Figure 11:
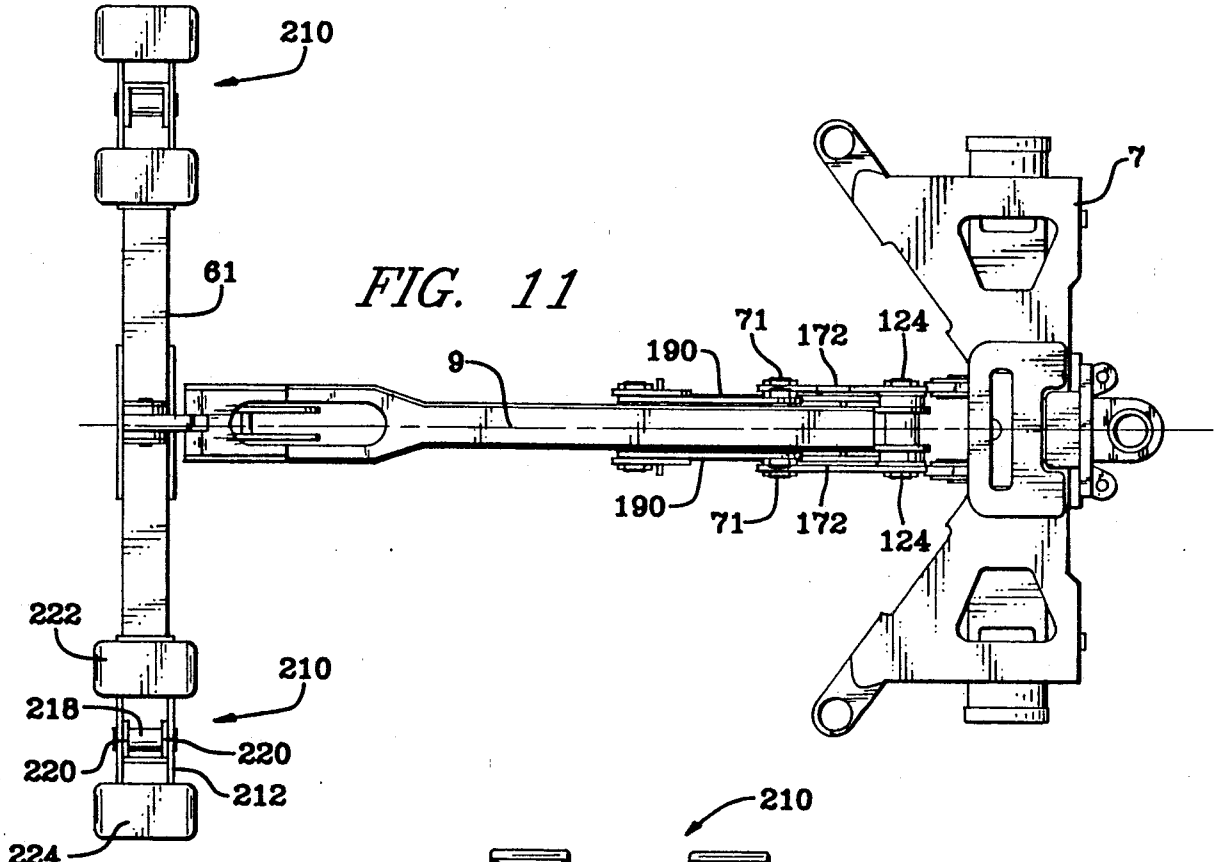
FIG. 11 is a top plan view of the invention, connected to the front frame portion of a roof bolter, with parts not shown.

Leveling pivot means 170 includes a pair of spaced-apart leveling links 172, one link contacting each sidewall 110 of support beam 51 (FIG. 10). Each link 172 is the same, and a description of one will suffice for both. As seen in FIG. 11, link 172 is a plate member having a top end 174 and a bottom end 176, each having a cylindrical bore 178 therethrough. Bore 178 is reinforced by cylindrical boss 180. Top end 174 is journaled around a pin (not shown) in back end pivot joint 124 of support beam 51 (Gig. 5). Bottom end 176 is journaled around a pin (not shown) in sidewall pivot joint 71 in front frame 15 (FIG. 5).

Figure 12:
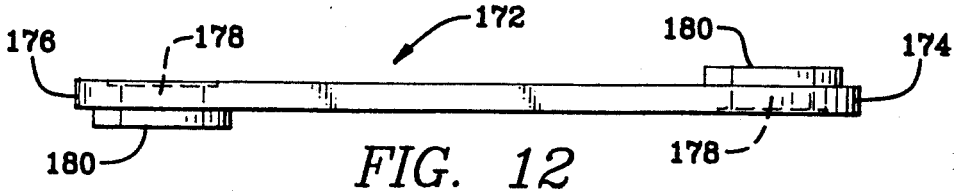
FIG. 12 is a side elevational view of a leveling link of the invention.
Figure 13:
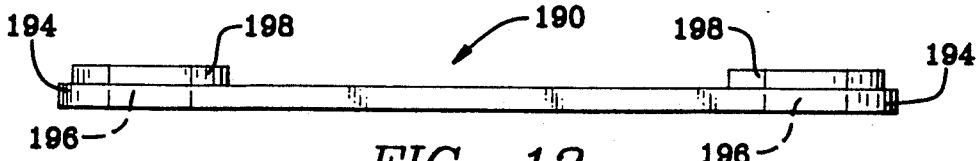
FIG. 13 is a side elevational view of a leveling strut of the invention.

Leveling pivot means 71 also includes a second pair of spaced-apart leveling struts 190, one strut contacting each sidewall 110 of support beam 51 (FIG. 10). Each strut 190 is the same, and a description of one will suffice for both. As seen in FIG. 12, strut 190 is a plate member having a top end 192 and a bottom end 194, each having a cylindrical bore 196 therethrough. Bore 196 is reinforced by cylindrical boss 198. Top end 192 is journaled around a pivot pin (not shown) in intermediate joint 130 on main support beam 51. Bottom end 194 is journaled around a pivot pin (not shown) extending through a lug 33 in sidewall 19 of main support frame 15 (FIG. 5).

Figure 14:
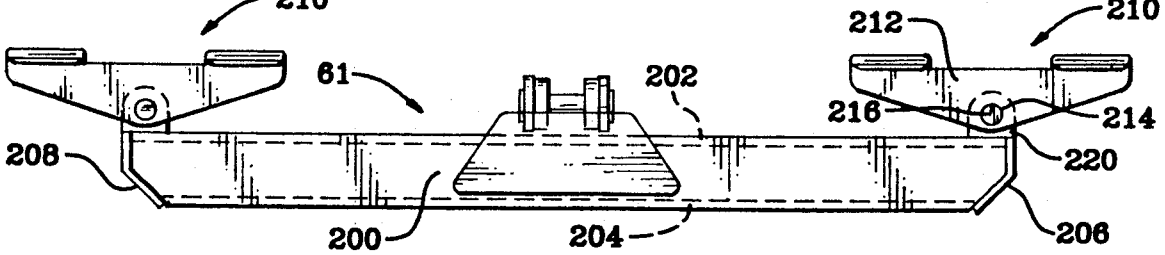
FIG. 14 is a front elevational view of the cross beam of the invention.

Referring now to FIGS. 11 and 14, cross beam 61 is shown include a pair of spaced-apart sidewalls 200, connected by top plate 202 and bottom plate 204 extending therebetween. Sidewalls 200 terminate at a first and second end 206, 208, respectively, and each en has pivotably connected thereto a rocker weldment, 210. Both rocker weldments 210 are the same, and a description of one will serve for both.

Rocker weldment 210 comprises a pair of spaced-apart sidewalls 212, joined together by suitable webbing (not shown). Each sidewall 212 is formed generally in the shape of an isosceles triangle, with the base portion of the triangle facing upwardly, and the apex of the triangle positioned adjacent to the crossbeam 61. A bore 214 extends through each sidewall adjacent to an apex 216 of the triangle, and in a plane parallel to axis 9. A pivot pin 218 extends through bore 214 between sidewalls 212, and through a pair of upstanding parallel lugs 220 on cross beam 61, thereby pivotably connecting rocker weldment to cross beam 61. Fastened at each end of the base portion of the triangle is a first and second contact pad 222 and 224, for contacting the mine roof (not shown).

Midway between ends 206 and 208 is positioned pivot joint 63, comprising a pair of spaced-apart, upstanding ears 222 spanning lug 116 of main support beam 51. A bore 224 extends through ears 222, and coincides with bore 118 of lug 116. Pivot pin 224 extends through bores 118 and 224, pivotably connecting cross beam 61 to main support beam 51.

Having described the invention, what is claimed is:

1. In a mobile roof bolter having a rear frame, a center frame in front of the rear frame, pivotably connected to the rear frame, and a front frame in front of the center frame, pivotably connected to the center frame, the improvement comprising:

(a) a temporary roof support in front of the front frame, extending along a longitudinal axis, pivotably attached to the front frame, said temporary roof support comprising:

i. a main support frame pivotably connected to the front frame, extending along said axis;

ii. a main support beam extending along said axis having a front end and a back end, said back end terminating above said main support frame, said main support beam adapted for raising and lowering above said main support frame, in a vertical plane extending along said axis;

iii. a cross beam in a plane extending transverse to said axis, pivotably attached to said front end of said main support beam, for supporting a mine roof;

iv. a ground-contact beam extending along said axis, below said main support beam, having a front end and a back end, said back end pivotably connected to said main support frame, said ground-contact beam adapted for raising and lowering said front end below id in support frame, in said vertical plane;

v. scissors pivot means extending between said front end of said main support beam and said front end of said ground-contact beam, for moving between an open and closed position, to raise and lower said front end of said main support beam and said front end of said ground-contact beam in relation to each other;

vi. primary support cylinder means in said vertical plane, extending between said main support frame and said scissors pivot means, for opening and closing said scissors pivot means;

vii. leveling pivot means connecting said back end of said main support beam and said main support frame, for permitting said back end of said main support beam to raise and lower in said vertical plane in relation to said main support frame, when said scissors pivot means opens and closes, whereby said cross beam raises and lowers vertically in a plane transverse to said axis; and vii. means for pivoting said temporary roof support up and down in relation to the front frame about a horizontal axis transverse to said longitudinal axis.

2. The invention of claim 1 in which said scissors pivot means comprises:

(a) a primary strut having a top end and a bottom end;

(b) said top end of said primary strut pivotably connected to said front end of said main support beam at a top strut pivot joint;

(c) a secondary strut having a top end and a bottom end;

(d) said top end of said secondary strut pivotably connected to said bottom end of said primary strut at a scissors pivot joint; and said bottom end of said secondary strut pivotably connected to said front end of said ground-contact beam.

3. The invention of claim 2 further comprising a foot weldment pivotably connected to said bottom end of said secondary strut and said front end of said ground-contact beam.

4. The invention of claim 3 in which said primary support cylinder means is hydraulically actuated.

5. The invention of claim 4 in which said main support beam includes a pair of spaced-apart sidewalls.

6. The invention of claim 5 in which said leveling pivot means comprises:

(a) a first pair of spaced-apart leveling links, each link contacting a different sidewall of said main support beam;

(b) each link having a top end and a bottom end;

(c) said top end of each link pivotably connected to said back end of said main support beam;

(d) said bottom end of each link pivotably connected to a sidewall of said main support frame;

(e) a second pair of spaced-apart leveling struts, each strut contacting a different sidewall of said main support beam;

(f) said top end of each strut pivotably connected to said main support beam at a pivot joint between said back end and said front end of said main support beam; and (g) said bottom end of each strut pivotably connected to a front end of a sidewall of said main support frame.

7. The invention of claim 6 in which said cross beam comprises:

(a) a pair of spaced-apart sidewalls extending between a first and second end; and (b) a rocker weldment pivotably connected to said cross beam at said first and second end.

8. In a mobile roof bolter having a front frame portion, the improvement comprising:

(a) a temporary roof support in front of the front frame, extending along a longitudinal axis, pivotably attached to the front frame, said temporary roof support comprising:

i. a main support frame pivotably connected to the front frame;

ii. a main support beam extending along said axis having a front end and a back end, said back end terminating above said main support frame, said main support beam adapted for raising and lowering above said main support frame, in a vertical plane extending along said axis;

iii. a cross beam in a plane extending transverse to said axis, pivotably attached to said front end of said main support beam, for supporting a mine roof;

iv. a ground-contact beam extending along said axis, below said main support beam, having a front end and a back end, said back end pivotably connected to said main support frame, said ground-contact beam adapted for raising and lowering said front end below said main support frame, in said vertical plane;

v. scissors pivot means extending between said front end of said main support beam and said front end of said ground-contact beam, for moving between an open and closed position, to raise and lower said front end of said main support beam and said front end of said ground-contact beam in relation to each other;

vi. primary support cylinder means in said vertical plane, extending between said main support frame and said scissors pivot means, for opening and closing said scissors pivot means;

vii. leveling pivot means connecting said back end of said main support beam and said main support frame, for permitting said back end of said main support beam to raise and lower in said vertical plane in relation to said main support frame, when said scissors pivot means opens and closes, whereby said cross beam raises and lowers vertically in a plane transverse to said axis; and viii. means for pivoting said temporary roof support up and down in relation to the front frame about a horizontal axis transverse to said longitudinal axis.

* * * * *